United States Patent [19]

Izumi

[11] Patent Number: 4,589,974

[45] Date of Patent: May 20, 1986

[54] OPTICALLY ANISOTROPIC CARBONACEOUS PITCH AND PROCESS FOR PRODUCING THE SAME

[75] Inventor: Takayuki Izumi, Ohi, Japan

[73] Assignee: Toa Nenryo Kogyo Kabushiki Kaisha, Tokyo, Japan

[21] Appl. No.: 415,382

[22] Filed: Sep. 7, 1982

[30] Foreign Application Priority Data

Sep. 7, 1981 [JP] Japan ..... 56-140782

[51] Int. Cl.[4] ..... C10C 3/00; D01F 9/12; D01F 9/20

[52] U.S. Cl. ..... 208/22; 208/39; 208/40; 423/447.2; 423/447.4; 423/447.6

[58] Field of Search ..... 208/22, 39; 423/447.2, 423/447.4, 447.6, 448, 449

[56] References Cited

U.S. PATENT DOCUMENTS

| | | | |
|---|---|---|---|
| 2,896,261 | 7/1959 | McAfee | 208/39 |
| 3,812,240 | 5/1974 | Whittaker et al. | 423/449 |
| 3,919,376 | 11/1975 | Schutz | 423/447.4 |
| 3,928,169 | 12/1975 | Conroy | 208/22 |
| 3,954,436 | 5/1976 | Honda et al. | 423/448 |
| 3,974,264 | 8/1976 | McHenry | 423/448 |
| 3,976,729 | 8/1976 | Lewis et al. | 423/447.8 |
| 4,017,327 | 4/1977 | Lewis et al. | 423/447.4 |
| 4,026,788 | 5/1977 | McHenry | 208/39 |
| 4,032,430 | 6/1977 | Lewis | 208/39 |
| 4,197,283 | 4/1980 | Crepaux et al. | 423/447.6 |
| 4,317,809 | 3/1982 | Lewis et al. | 423/447.4 |
| 4,363,670 | 12/1982 | Noguchi et al. | 208/45 |
| 4,454,019 | 6/1984 | Izumi et al. | 208/22 |
| 4,454,020 | 6/1984 | Izumi et al. | 208/22 |

FOREIGN PATENT DOCUMENTS

| | | | |
|---|---|---|---|
| 6125210 | 10/1981 | Japan | 428/448 |
| 7047921 | 3/1982 | Japan | 423/447.2 |

OTHER PUBLICATIONS

Chwastiak, S., et al, Quantitative Determination of Mesophase Content in Pitch, Carbon, vol. 19, No. 5, pp. 357–363.

*Primary Examiner*—John Doll
*Assistant Examiner*—Helane Myers
*Attorney, Agent, or Firm*—Fleit, Jacobson, Cohn & Price

[57] ABSTRACT

This invention describes a substantially homogeneous, optically anisotropic carbonaceous pitch characterized in that the major portion of said pitch consists of a continuous, optically anisotropic phase, said optically anisotropic phase contains spherules of an optically isotropic phase having diameters of not more than about 100 μm and dispersed in said optically anisotropic phase, the content of said optically isotropic spherules is up to about 20% on the basis of said pitch as a whole, said pitch contains at least about 30 wt % (based on said pitch) of a quinoline-soluble component, and said pitch has a lower softening point.

18 Claims, 4 Drawing Figures

(x 50)

(x 200)

(x 400)

(x 800)

OPTICALLY ANISOTROPIC CARBONACEOUS PITCH AND PROCESS FOR PRODUCING THE SAME

BACKGROUND OF THE INVENTION

1. Field of the Invention

Development of high-performance carbon materials having light weight, high strength and high elastic modulus has been desired eagerly at present in various industrial fields such as the car industry, the airplane industry and other wide range of technical fields. Carbon fibers or molding carbon materials have been attracting an increasing attention as the materials that satisfy these needs.

The present invention relates to an optically anisotropic carbonaceous pitch suitable for the production of carbon materials containing carbonaceous fibers having light weight, high strength and high elastic modulus and other carbon materials, to a process for producing the optically anisotropic carbonaceous pitch and to a process for producing carbon fibers and graphite fibers by melt-spinning, carbonizing and graphitizing the optically anisotropic carbonaceous pitch.

2. Description of the Prior Art

Optically anisotropic pitches that have been known conventionally such as those disclosed in Japanese Patent Laid-Open Nos. 19127/1974 and 80635/1975 contain an optically anisotropic phase portion (which will hereinafter be referred to as "AP", whenever necessary) that substantially corresponds to the quinoline-insoluble content (or pyridine-insoluble content). If an AP portion content of these pitches approaches 100%, the softening point rises significantly, bringing about drawbacks that the spinning temperature becomes as high as 400° C. or more and evolution of decomposition gases and polymerization of the pitches occur during spinning. In accordance with the conventional method of spinning carbon fibers, the content of the AP portion is restricted to 90% or below, especially in the range of from 50% to 70% and spinning is effected at a temperature at which thermal decomposition and thermal polymerization do not occur remarkably.

Such a conventional pitch composition is a mixture of the AP and considerable quantities of an optically isotropic phase (which will hereinafter be referred to as "IP", whenever necessary), and so is a so-called "heterogeneous pitch". Hence, yarn breaking is likely to occur during spinning, the fiber fineness becomes non-uniform and the fiber strength decreases.

The pitch material disclosed in Japanese Patent Publication No. 8634/1974 seems to consist substantially of 100% AP but is a specific pitch whose chemical structure is specified. In other words, it is a pitch which is produced by the thermal polymerization of expensive pure materials such as chrysene, phenanthrene, tetrabenzophenazine, and the like, and has a relatively regular structural molecular weight. If the pitch is produced by use of general mixture of heavy oils or tars as starting materials, the softening point of the resulting pitch inevitably becomes extremely high.

On the other hand, the pitch as the starting material of carbon fibers, disclosed in Japanese Patent Publication No. 7533/1978, has a low softening point and a low spinning temperature and spinning can be made easily. However, the reference does not disclose the AP content. In addition, the starting hydrocarbons are polycondensed by use of a Lewis acid catalyst such as aluminum chloride and hence, the composition and structure of the pitch are specific and the strength and elastic modulus of carbon fibers produced from the pitch are relatively low. The invention involves also a drawback that the catalyst used for the reaction can not be completely removed easily.

The pitch material disclosed in Japanese Patent Laid-Open No. 55625/1979 is a homogeneous pitch consisting completely of 100% AP and its molecular weight distribution is relatively narrow. As will be described below in further detail, the pitch of this type is likely to have a small content of an n-heptane-soluble component (hereinafter referred to as the "component O") and a relatively small content of an n-heptane-insoluble but benzene-soluble component (hereinafter referred to as the "component A") that are important components of the optically anisotropic pitch of the present invention. In the remaining benzene-insoluble components, the contents of a quinoline-soluble component (hereinafter referred to as the "component B") and a quinoline-insoluble component (hereinafter referred to as the "component C") are relatively large. Even if their molecular weight distribution is narrow, the softening point of the pitch material is likely at least about 330° C. as its practical character, and the spinning temperature must be elevated close to 400° C. Spinning on the industrial scale at such a temperature is still difficult to practice.

The pitch materials disclosed in Japanese Patent Laid-Open Nos. 160427/1979, 58287/1980, 130809/1980, 144087/1980 and 57881/1981 are obtained by solvent-extracting an isotropic pitch or a pitch containing a trace amount of AP, extracting a portion whose major component is ready to form the AP and which has a small content of the component C, and melting said portion. A pitch having uniquely the content of the component C of 25% or below can be produced. As those skilled in the art can easily assume from the process and data disclosed in the reference, however, the pitch has a high softening point so that the spinning temperature is as high as around 400° C. and stable spinning on the industrial scale is still difficult. Any way, it is assumed from the process and data disclosed in the reference that the resulting pitch is a particular pitch consisting of component B as the principal component, though the content of the component C is small.

As described above, all the heretofore known, homogeneous, optically anisotropic pitches having the AP content of close to 100% have so high softening point as 330° C. and can not be spun easily in a stable manner. On the other hand, the heretofore known pitches having a low softening point are heterogeneous except those which are produced from specific starting materials and have specific composition and structure. Spinning of these pitches are likewise difficult so that it has been extremely difficult to obtain carbon fibers having excellent crystaline characteristics.

In conjunction with stipulation of the pitches the conventional methods stipulate optically anisotropic pitches by means of the partial chemical structure or the average molecular weight or the quinoline-insoluble component (or pyridine-insoluble component) of the pitches. However, these simple stipulation methods are not enough, because an optically anisotropic pitch composition having a low softening point and homogeneity for the production of high-performance carbon fibers or other carbon materials can not be stipulated by these and are improper. For, so-called "optically anisotropic pitch" compositions are mixtures of compounds of numerous kinds having extremely wide range of chemical structures and a variety of molecular weight ranging from several hundreds up to several tens of thousands and even those having molecular weights comparable to those of a coke. Accordingly, the pitches can not be stipuled only by the characteristics of their partial chemical structure or the average chemical structure of the pitches as a whole.

SUMMARY OF THE INVENTION

The inventors of the present invention have carried out intensive studies on optically anisotropic pitch composition suitable for the production of high-performance carbon fibers and have found the following facts. Namely, an optically anisotropic pitch is one that has good molecular orientation in which the laminate structure of condensed polycyclic aromatic groups develops well. However, there are various kinds of optically anisotropic pitches existing as mixtures. Among them, those pitches which have a low softening point and are suitable for the production of homogeneous carbon fibers have a specific chemical structure and composition. In other words, the inventors have found that in optically anistropic pitches, the compositions, structures and molecular weights of the aforementioned component O (n-heptane-soluble component) and component A (n-heptane-insoluble but benzene-soluble component) are extremely important. On the basis of these findings, the inventors of the present invention filed previously Japanese Patent Application No. 162972/1980.

Thereafter, the inventors have furthered their studies on the mixing ratio of the AP and IP in the pitches and their microscopic morphology and have found that though a completely single-phase pitch substantially consisting of 100% AP and having a softening point ranging from 250° C. to 300° C. can be produced, the production condition for such a pitch is relatively limited and hence, it is not so easy to produce constantly a pitch having a sufficiently low softening point in accordance with changes in the starting material. In other words, the inventors have found that it is not so easy to produce constantly a pitch having a proper spinning temperature and 100% AP content stably on the industrial scale.

If pitches have an excessively large IP portion, or if they contain at least 30% of IP, their softening point can generally be lowered sufficiently. However, they behave as if they consist of two mixed liquid phases having different viscosities during spinning and their spinnability is so inferior that carbon fibers produced therefrom have been confirmed to possess defective properties.

In the course of further studies, it has been found that there exists a pitch whose IP portion content is up to about 20% and preferably up to about 10%, in which the major portion of the IP exists in a state of dispersion inside a matrix (mother phase accounting for the major proportion of the pitch) of the AP in the form of a spherules having a diameter of up to about 100 μm, preferably up to about 50 μm and further preferably up to about 20 μm, and which has a sufficiently low softening point. Such a pitch has been found to possess good spinnability and to be optimal as a precursor for producing carbon fibers having high performance. In addition, it has also been found that such a pitch can be produced easily and stably on the industrial scale and provides substantially constant properties. Thus, the present invention is completed.

Anyway, it has been known conventionally that the IP spherules are dispersed in the AP and this phenomenon has been often observed in practice. However, since most of them are IP spherules having a diameter of 100 μm or more, such a state has been believed unfavorable for spinning or the like. However, the state of dispersion of the IP and its effect that will be hereinafter disclosed in the present invention have not been known conventionally at all and such a pitch has not been disclosed at all in the prior art.

The inventors of the present invention have examined in detail the solubility of such a pitch in solvents such as quinoline, pyridine, benzene, n-heptane and the like, its viscosity at various temperatures and shear rates, and its carbon-to-hydrogen (C/H) atomic ratio, and have clarified their especially preferred ranges. Thus, the more distinct characteristics of the pitch material of the present invention have been discovered and the present invention is completed.

The present invention also includes a process for producing a pitch having the abovementioned characteristics. Particularly, the process found out by the inventors of the present invention comprises the steps of depositing the major portion of the AP of the pitch, which has the specific composition and softening point and remains in the stage in which about half of the AP is contained in the spherical form, under the condition where the pitch is kept molten and the major portion of the AP can be easily deposited, and separating this portion having a higher AP concentration in the lower layer from the portion having a lower AP concentration in the upper layer.

The starting material for the abovementioned process, or the pitch having the composition and softening point falling within the specific ranges and containing about a half of AP, can be produced by a heretofore known method. Heavy hydrocarbon oils, that is, tar, commercially available pitches or the like are thermally reacted at a temperature within the range of from about 380° C. to about 460° C. for a necessary period of time and thereafter topping is effected at a sufficiently low temperature (stripping with an inert gas or vacuum distillation). Alternatively, the starting material is thermally reacted at about 380° C. to about 460° C. for a necessary period of time during topping. In this manner, the pitch containing about half of AP and having the specific composition and softening point for use as the starting material of the present process can be produced.

In the abovementioned processes, the pitch of the upper layer having a low AP concentration after separating the pitch of the lower layer having a high AP concentration in the settling separation step is recycled to the thermal decomposition polycondensation step and to the topping step. After being adjusted to a suitable AP concentration, composition and softening point, the pitch can be passed through the subsequent deposition step. Since the thermal decomposition polycondensation and settling separation are repeated in the present invention in this manner, a high-quality optically anisotropic pitch can be produced with a high yield.

The present invention is based upon the above-mentioned various findings.

The primary object of the present invention is to provide an optically anisotropic carbonaceous pitch suitable for the production of high-strength, high-modulus carbon materials, especially carbon fibers, which pitch has a low softening point.

It is another object of the present invention to provide an optically anisotropic pitch suitable for the production of high-strength, high-modulus carbon materials, especially carbon fibers, which pitch is a homogeneous, optically anisotropic carbonaceous pitch having high molecular orientation.

It is still another object of the present invention to provide an optically anisotropic carbonaceous pitch for the production of high-strength, high-modulus carbon fibers, which pitch has such excellent spinnability that it can be spun at a temperature sufficiently lower than a temperature at which the thermal decomposition polycondensation reaction proceeds remarkably.

It is still another object of the present invention to provide an optically anisotropic carbonaceous pitch suitable for the production of carbon materials having a high strength and high elastic modulus, which pitch has a specific phase suitable for this purpose, or, a specific content of IP in the AP matrix, which contains a suitable amount of quinoline- (or pyridine-) insoluble component whose content is obviously smaller, however, than the AP content, which consequently has a sufficiently low softening point and good moldablity and sufficient molecular orientation and which is practically homogeneous.

It is still another object of the present invention to provide an optically anisotropic carbonaceous pitch which is more suitable for the production of high-strength, high-modulus carbon materials and which has sufficiently small viscosity values at a molding temperature.

It is still another object of the present invention to provide an optically anisotropic carbonaceous pitch suitable for the production of high-strength, high-modulus carbon materials, which pitch has a specific composition in regard to a analysis by solvent fractionation, that is to say, contains components O, A, B and C falling within the specific ranges and has also a carbon-to-hydrogen (C/H) atomic ratio falling within the specific range.

It is still another object of the present invention to provide a process for producing efficiently an optically anisotropic carbonaceous pitch suitable for the production of high-strength high-modulus carbon fibers.

It is still another object of the present invention to provide a process for producing an optically anisotropic pitch suitable for the production of high-strength high-modulus carbon materials, which pitch has a specific phase, which contains a suitable amount of quinoline- (or pyridine)-insoluble component whose content is smaller than the AP content, which therefore has a sufficiently low softening point and high moldability and sufficient molecular orientation and which is practically homogeneous.

It is a further object of the present invention to provide a process for producing high-strength high-modulus carbon fibers and graphite fibers by use of a novel optically anisotropic carbonaceous pitch which has such a low softening point that it can be stably melt-spun at a sufficiently low temperature, which is homogeneous and which has excellent molecular orientation.

Figure 1:
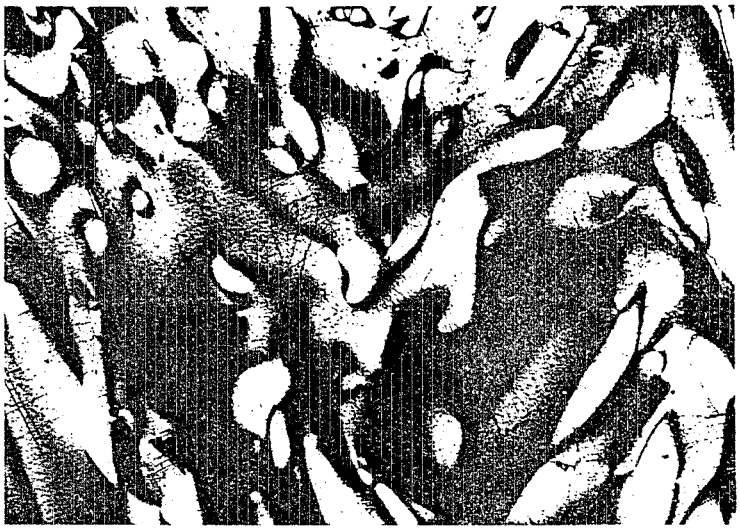
FIG. 1 is a micrograph in 50X magnification of the polished surface of the optically anisotropic carbonaceous pitch of the present invention when taken under a crossed nicol with a reflecting polarizing microscope.

In these micrographs, dark lines represent scratches in polishing and dark circles or ellipses represent fine IP spherules. It was found that most of IP spherules have diameters up to 5 $\mu$m.

DESCRIPTION OF THE PREFERRED EMBODIMENTS

Next, the terminology and methods of measurement and analysis used for describing the present invention will be explained.

The term "optically anisotropic phase" of the pitch has not always been standardized in the art and in various technical literature.

The term "optically anisotropic phase" used in this specification refers to one of morphologies of the pitch-forming components and is defined in the following manner. Namely, the section of a pitch mass solidified close to room temperature is polished and observed under a crossed nicol with a reflecting polarizing microscope. If luminance is observed while the sample or the crossed nicol is being rotated, that portion of the sample is defined as being "optically anisotropic" and a portion at which luminance is not observed is defined as being "optically isotropic".

A clear boundary can be observed between the AP and the IP. (Generally, foreign matters such as dust, air bubbles and the like that belong neither to the AP nor the IP can be obviously discriminated.) The optically anisotropic phase may be considered the same as a so-called "meso phase", but two kinds of "meso phases" exist; one containing a major proportion of components that are substantially insoluble in quinoline or pyridine and the other containing a major proportion of components that are soluble in quinoline or pyridine. The term "AP" used herein principally refers to the latter "meso phase".

It is believed that the AP consists principally of molecules having a chemical structure in which the planarity of condensed rings of polycyclic aromatic groups develops well in comparison with that of the IP and these molecules aggregate and associate with one another in the form in which their planar surfaces are laminated. Hence, the AP at the melting temperature is believed to be in the state of a kind of liquid crystal. When the AP is spun while it is being extruded through a thin spinneret, therefore, the planes of the molecules are arranged substantially parallel to the fiber axis so that carbon fibers produced from this optically anisotropic pitch show high modulus.

Determination of the AP or the IP is carried out by taking a photograph while it is being observed under a crossed nicol with a polarizing microscope in order to measure the proportion of an area occupied by the AP or the IP. Statistically, the area ratio represents substantially the percentage by volume.

However, since the difference of specific gravity is about 0.05 between the AP and the IP, the percentage by volume may be approximately regarded as being equal to the percentage by weight in their determined values. Though the condition of the AP and IP molten at high temperatures may be somewhat different from that at room temperature, the present specification stipulates the AP and IP observed at room temperature.

When the AP or the IP forms spherules, their diameters are determined by observing the cross section of a pitch mass with a reflecting polarizing microscope and taking its photograph. In this case, since the section of the spherules is observed, it is not possible, in principle, to actually measure the distribution of the true spherule diameters. Accordingly, the present invention employs the following method. Among a large number (1000 to 10,000) of AP or IP spherules, only those having a section image of a circle of at least 1 μm diameter are observed and if at least 99.9% of these spherules have a diameter of up to x μm, the diameter of the assembly of spherules are defined to be approximately or substantially up to x μm.

More definitely, the determination is carried out in the following manner. The AP or IP spherules having a section of at least 50 μm diameter are observed by use of a microscope having magnification of 50X, for example, in a visual field of the pitch section as wide as possible. Next, the spherules of up to 50 μm, especially up to 10 μm, are observed using a microscope of 200X or 400X.

Needless to say, when the abovementioned spherule is AP, it is surrounded by the IP and when the IP spherule is observed, it is surrounded by the AP. In the present specification, a pitch in which the AP accounts for the major portion and the IP is included in the form of spherules or amorphous islands in the AP is defined as an optically anisotropic pitch. In other words, pitches which are referred to as the "optically anisotropic pitches" do not mean perfectly 100% AP.

In conjunction with the homogeneity of the pitches, the present invention employs the following definition. Since excellent homogeneity is observed in practical melt-spinning in those pitches which are found to have a sufficiently low IP content as a result of the abovementioned measurement, whose section does not substantially contain any solid particles (diameter of up to 1 μm) that can be detected in the observation using a reflecting polarizing microscope and which are substantially free of foaming due to volatile matter at a melt-spinning temperature, these pitches are defined as "substantially homogeneous, otpically anisotropic pitches".

In the present invention, the IP content is limited to about 20% or below for "substantially homogeneous optically anisotropic pitch".

If a pitch contains the IP in an amount exceeding 20% or if the size of the IP dispersed in the AP is relatively great even if the IP content is up to 20%, the pitch is an obvious mixture of the two phases consisting of a high-viscosity AP and a low-viscosity IP. If the pitch is spun, therefore, it behaves as a pitch mixture having remarkably different viscosities so that yarn breaking occurs frequently, a high-speed spinning is difficult, fibers of sufficiently small fineness can not be obtained and fluctuation in the fiber diameter is inevitable. As a result, carbon fibers having high performance can not be obtained. If unmeltable, fine solid particles and low-molecular weight volatile matters are contained in the pitch during melt-spinning, the resulting spun pitch fiber would contain air bubbles and solid foreign matters so that spinnability is naturally reduced.

The term "softening point of pitch" means a temperature at which the pitch changes from solid to liquid. The softening point can be determined from peak temperatures of absorption and discharge of the latent heat on melting or solidification of the pitch using a differential scanning type calorimeter. The temperature is in agreement within the range of ±10° C. with the measured point value of the pitch sample measured in accordance with other measuring methods such as a ring-and-ball method, a micro melting point method, and so forth.

The term "low softening point" used in this specification means a softening point within the range of from 230° C. to 320° C. This softening point is closely related with a melt-spinning temperature of the pitch. Though varying to some extents depending upon pitches, a temperature higher by 60° C. to 100° C. than the softening point is generally a temperature at which the pitch exhibits a viscosity suitable for spinning. Accordingly, if the pitch has a softening point higher than 320° C., the spinning temperature becomes higher than 380° C. at which the thermal decomposition polycondensation reaction occurs and spinnability is naturally reduced due to the formation of decomposition gases and unmeltable matter. In addition, the resulting spun pitch fibers tend to contain air bubbles and solid coke-like matter, causing various defects. On the other hand, if the pitches have a softening point below 230° C., the infusibilizing treatment must be carried out at a low temperature for an too long an extended period of time, becomes complicated to practise and results in the increase in the cost of production.

The terms "component O, component A, component B and component C" as the constituents of the pitch used in this specification are defined in the following manner. A powder pitch is placed in a cylindrical filter having an average pore diameter of 1 μm and is heat-extracted for 20 hours with n-heptane using a Soxhlet extractor and the resulting n-heptane-soluble component is defined as "component O". Heat-extraction is carried out in succession with benzene for 20 hours and the resulting n-heptane-insoluble but benzene-soluble component is defined as "component A". The benzene-insoluble component is further centrifuged (in accordance with JIS K-2425) using quinoline as the solvent and the resulting benzene-insoluble but quinoline-soluble component, that is a so-called "β-resin", is defined as "component B" and the quinoline-insoluble component as "component C".

Fractionation of these components can be carried out in accordance with the method described in "Sekiyu Gakkaishi", Vol. 20, No. 1, page 45 (1977), for example.

As the method of extracting and analyzing the component C, it is also possible to employ the ASTM D-231876 method (in which extraction and filtration are effected at 75° C.), a boiling quinoline method (in which extraction and filtration are effected in boiling quinoline), a boiling pyridine method (Soxhlet extraction using pyridine), and so forth. The inventors of the present invention have examined a variety of pitch samples and compared the results with one another and have found that the JIS quinoline method, the ASTM method and the boiling pyridine method provide the data that are substantially equal to each another, but the boiling quinoline method provides the data of the insoluble component which are lower by from $\frac{3}{4}$ to $\frac{1}{2}$ than those obtained by the other methods. Hence, the boiling quinoline method is not used in the present invention.

In the present invention, the viscosity characteristics are measured by use of a "Rheomat 30", a rotary high-temperature viscometer produced by Contraves Co. More definitely, measurement is carried out inside an electric oven kept in a nitrogen atmosphere by changing the shear rate at a predetermined temperature within the range of from 250° C. to 400° C. in accordance with a cone plate system or a rotary cylinder system.

Now, the present invention will be described in further detail.

Broadly speaking, the present invention relates to an optically anisotropic carbonaceous pitch which has a suitable IP content, a specific mixture form of the AP and the IP in which the IP is dispersed in the AP matrix in the form of extremely small spherules, a sufficiently small quinoline- or pyridine-insoluble component (component C) but a large content of benzene-soluble component and thus has a softening point ranging from 230° C. to 320° C., to a process for producing such a pitch and to a process for producing carbon fibers and graphite fibers from such a pitch.

The optically anisotropic carbonaceous pitch in accordance with the present invention will be described in further detail. Though consisting of a mixture of the AP and the IP, the pitch has the AP content of at least about 80% and hence, the IP content of up to about 20%. When the section of the pitch is observed with a polarizing microscope, it can be clearly seen that the AP accounts for the major portion and froms a matrix and extremely small IP in the form of a disc, or occasionally in the form of a slightly deformed ellipsis, having a diameter of up to 100 μm and mostly from 1 μm to 50 μm, are distributed in the matrix. (This indicates clearly the presence of fine spherical or oblate-spherical IP.) Moreover, most of, or substantially all, the spherules of IP have a diameter of up to 20 μm.

Figure 2:
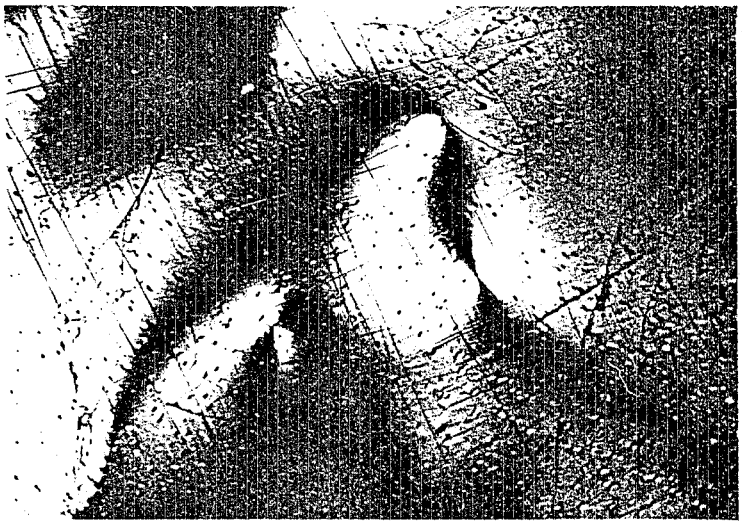
FIG. 2 is a micrograph in 200X magnification with the reflecting polarizing microscope.
Figure 3:
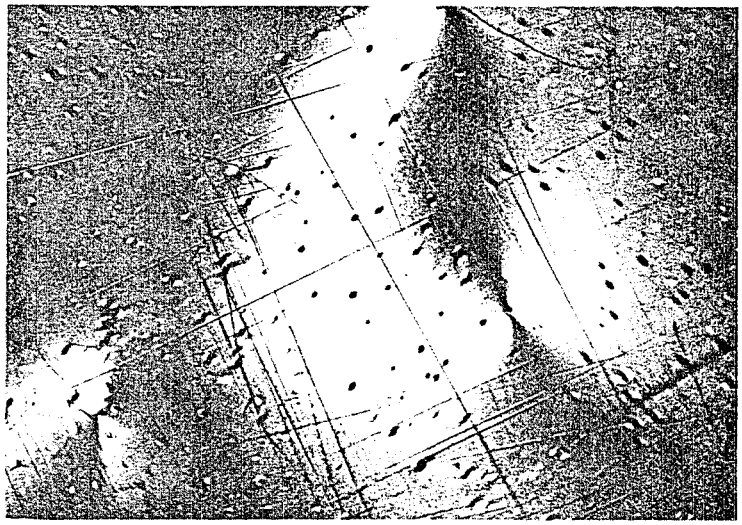
FIG. 3 is a micrograph in 400X magnification with the reflecting polarizing microscope.
Figure 4:
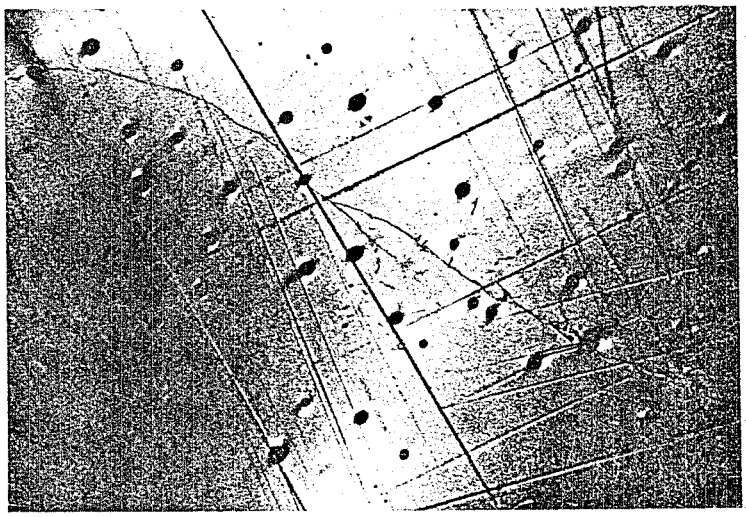
FIG. 4 is a micrograph in 800X magnification with the reflecting polarizing microscope.

FIG. 2 is a micrograph of the pitch taken by a reflecting polarizing microscope (200X) and FIGS. 3 and 4 show the micrograph of the same pitch in FIG. 2 in further magnification (400X and 800X, respectively). The portion of black fine circles contained in the AP has been confirmed to be an optically isotropic pitch by a dark field method or an interference contrast method. In the present invention, it has been found that if such fine spherical IP is contained in the pitch, the pitch does not exhibit heterogeneity during melt-spinning but behaves as a substantially homogeneous pitch. Such optically isotropic fine spheres appear especially remarkably in the case of optically anisotropic pitches produced in accordance with the below described production process of the invention. It has also been found that the IP spherules do not impede spinning at all, but keep the softening point and viscosity of the pitches at sufficiently low levels in view of the characteristics of the pitches as a whole and function as a kind of fluidity-improving agent which permits the molten pitch to flow out continuously and smoothly from a thin nozzle orifice during melt-spinning.

Generally, the IP has a low viscosity which is one hundredth or one thousandth of that of the AP. The content and size of the IP spherules can be controlled in accordance with a production process but they provide good results for the spinning of pitches if they remain within a certain range. They also provide good effects on the properties of the resulting carbon fibers or graphite fibers as the product, especially their tensile strength. In other words, if the IP content is up to about 20% and if the IP is dispersed in the AP in the abovementioned state of fine spheres, homogeneous extrusion and spinning can be easily performed in the spinning step and carbon fibers and graphite fibers obtained by infusibilizing, carbonizing and graphitizing the pitch fiber have excellent performance.

On the other hand, if the IP content is greater than about 20%, especially about 30%, the softening point and spinning temperature generally become lower, but not only the fine spherical IP but also large IP spherules of a diameter of 100 μm or more and in most cases, from about 200 μm to 500 μm, or the IP masses having a formless shape, are dispersed in considerable quantities. Since the particle diameter is close to the size of a spinning nozzle, yarn breaking and non-uniformness of the fiber diameters would occur when the pitch is spun because it is analogous to spinning of a pitch having two liquid phases mixed therein by extruding from the nozzle and stretching. In any case, such a pitch has low spinnability or can not be spun. Needless to say, the carbon fibers and graphite fibers produced from such a pitch have considerably inferior properties both in strength and elastic modulus and, especially, desired tensile strength can not be obtained.

In accordance with the process of the present invention, it is possible to produce a pitch which has a sufficiently low softening point, a sufficiently low spinning temperature, and the IP content of below about 20% and in which extremely fine IP spherules whose diameters are substantially or all below 20 μm and preferably 10 μm, are uniformly dispersed. It is also possible to reduce the IP content below about 1% to about 10%. Such a pitch has increased homogeneity in spinning and provides carbon fibers and graphite fibers having improved performance. Especially, pitches having the IP content of from about 3% to about 10% provide still excellent effects.

In the present invention, the content of the IP spherules dispersed in the AP matrix of the optically anisotropic pitch is determined by taking micrographs of various portions of a pitch section using a microscope of 400X or 800X magnification to measure the diameter distribution and calculate the average content. According to this method, the IP content of about 1% or more can be actually measured. Measurement error in diameters becomes unavoidably great for the IP spherules having a diameter smaller than 1 μm, but such IP spherules are not relatively much and their influences upon the content is substantially small.

Besides the abovementioned IP morphology which characterizes the pitches of the present invention, another feature of the pitches resides in that the quinoline- or pyridine-insoluble component, that is the "component C" herein defined, is sufficiently smaller than the AP content.

Depending upon the production processes (or kinds) of pitches, there are some pitches in which the AP content (%) is substantially equal to that of the component C. Such pitches are generally obtained in accordance with the conventional techniques.

As described already, it is necessary in the pitch of the present invention that the AP content is at least about 80% and the content of the component C is up to 70% by weight, preferably, up to 50% by weight. From the aspect of easiness in production and spinnability and from the performance of the resulting carbon materials, it is necessary that the content of the component C is from 20 wt% to 50 wt%. More particularly, the content of rom 30 wt% to 40 wt% is preferred for the ease of production.

In the present invention, if the component C exceeds 70 wt%, the softening point is likely to become higher, whatever the AP content may be. Such pitches can not be spun easily or can not be spun at all, even if the IP consists of fine spherules.

On the other hand, those pitches can also be produced which scarcely contain the component C or which contain below 20 wt% of the component C and at least 80% of the AP. However, such pitches are not preferred because they contain large quantities of quinoline-soluble but benzene-insoluble component (or the "component B" defined in this specification) that is generally referred to as "β-resin" and consequently have higher softening points.

According to the studies of the inventors of the present invention, it has been found that the most preferred pitches contain a suitable amount of component C as a compatible component in harmony with other components (O, A and B). Such pitches have a low softening point and a high AP content and provide good performance for carbon materials produced therefrom.

It is still another characteristic feature of the optically anisotropic pitch of the present invention that a sufficiently low, but not excessively low, softening point of the pitch is from about 230° C. to about 320° C. It is assumed that this feature is somehow related with the abovementioned high AP content, the presence of IP spherules dispersed in the AP, low C content, and so forth.

In the abovementioned range of softening point, those optically anisotropic pitches which can be produced more easily and which are excellent as the starting material for molding carbon materials have a softening point ranging from 240° C. to 290° C. Such optically anisotropic pitches have high moldability such as melt-spinning, can be used at a sufficiently lower temperature than the thermal reaction temperature of the pitches, such as from 300° C. to 360° C. as the spinning temperature in the melt-spinning step, and provide the advantage that the design of a spinning machine and its operation are easy.

Such low spinning and molding temperatures have not been known at all conventionally when optically anisotropic pitches having a high AP content are used.

The properties of the optically anisotropic pitch of the present invention found out by the inventors will be further described. That is, the viscosity of the pitch measured at a predetermined temperature is by far lower than that of a heretofore known optically anisotropic pitch having a large AP content. Beside the aforementioned characteristic features, i.e., the AP content, the IP morphology and the softening point, still another feature of the pitch of the present invention is that it shows a viscosity of from about 10 poise to about 200 poise measured at 350° C. and from about 2 poise to about 50 poise measured at 380° C. When the viscosity is measured at these temperatures while changing the shear rate, the viscosity shows substantially a constant value at least up to the shear rate of 50 $sec^{-1}$. That is, the optically anisotropic pitch according to the present invention shows nearly completely a Newtonian flow. This means that such an optically anisotropic pitch can be smoothly extrusion-spun because the shear rate to the pitch applied when the pitch passes through a nozzle of a spinning machine during melt-spinning is from about 10 to about 50 $sec^{-1}$. Such an optically anisotropic pitch has not been known at all in the past and is really amazing.

From still another aspect, the optically anisotropic pitch of the present invention has the characterizing feature in that it mostly contains a large quantity of benzene-soluble components. In other words, the pitch contains from 20 wt% to 50 wt% of the benzene-soluble component and hence, from 50 wt% to 80 wt% of benzene-insoluble components.

More specifically, particularly excellent optically anisotropic pitches having good spinnability and providing good performance for the resulting carbon materials are those which contain from 15 wt% to 40 wt%, on the total of the pitch, of the n-heptane-insoluble component, that is, the component A, in the abovementioned benzene-soluble component, and from 5 wt% to 15 wt% of the n-heptane-soluble component, that is the component O.

If the benzene-insoluble but quinoline-soluble component, which is generally referred to as the "β-resin" and is defined as the "component B" in the present invention, is contained in an amount of from 20 wt% to 50 wt% of the total of the pitch, such a pitch has a large AP content, a sufficiently low softening point and good spinnability and is an excellent optically anisotropic pitch providing good performance for carbon materials obtained therefrom. Though the ratio of the carbon atoms to the hydrogen atoms, i.e., C/H, of the pitch as a whole varies depending upon the production process of the pitch, an optically anisotropic pitch having an especially low softening point and exhibiting excellent properties has the C/H of up to 2.0, preferably in the range of from 1.6 to 1.9 and more preferably in the range of from 1.65 to 1.80. Such an optically anisotropic pitch having a sufficiently small C/H ratio and a high AP content has not been known at all to date.

The optically anisotropic pitch of the present invention can be produced in various manners. A typical production process, though not limitative, will be described below.

There has conventionally been known a process of subjecting a heavy hydrocarbon oil, tar or a commercially available pitch as an ordinary starting material for producing a pitch to the sufficient thermal decomposition polycondensation reaction in a reactor held at a temperature of from 380° C. to 500° C. with stirring while effecting topping with an inert gas to increase the AP content in the residual pitch. According to this process, however, the thermal decomposition polycondensation reaction proceeds excessively when, in general, the AP content exceeds 80%, though varying to some extent depending upon the starting material and temperature used, so that the content of the component C tends to exceed 70 wt%, the IP is not easily dispersed in the form of fine spheres and the softening point is likely to become 300° C. or more and, in most cases, 330° C. or more, when AP content exceeds 80%.

Accordingly, the inventors of the present invention devised a process for producing an optically anisotropic pitch having a higher AP temperature in which the thermal decomposition polycondensation reaction is terminated halfway, the polycondensate is settled while kept at a temperature within the range of from 350° C. to 400° C. so as to grow and age an AP having a large density in the lower layer and the AP is separated from a portion of the upper layer containing a major proportion of IP and having a small density and is withdrawn.

The inventors filed previously this process as Japanese Patent Application No. 99646/1980. The present invention relates to a novel process completed by further improving this prior process.

In the present invention, when a carbonaceous pitch containing a suitable amount of AP is kept settled at a temperature within the range of from 350° C. to 430° C., the AP portion precipitates because it has a greater specific gravity than the IP portion, coalesces with each other and deposits in the lower layer. About 80% or more of the AP forms a continuous phase, in which the IP is contained in the island form or in the form of fine spherules, as the pitch of the lower layer. The upper layer pitch consists predominantly of the IP in which the AP is dispersed in the form of fine spherules. However, since the boundary between these upper and lower layers is clear and the viscosity of the upper layer in the molten state is remarkably different from that of the lower layer, the lower layer can be separated from the upper layer and withdrawn, thereby providing an optically anisotropic carbonaceous pitch having a low softening point and a high AP content.

The inventors of the present invention have examined characteristics of the pitches required in the settling and separation operation step of the AP (hereinafter referred to as the "settling separation step") in order to obtain the optically anisotropic carbonaceous pitch of the present invention that has suitably controlled IP morphology as well as IP content and hence, is homogeneous and has a low softening point and excellent moldability. In other words, the present invention relates to a novel production process thus elaborated.

Hereinafter, the pitch production process of the present invention will be explained as to the essential points. It is essential in this invention that the starting pitch to be used in the deposition separation step must have a softening point of up to 250° C., and contain from about 20% to about 70% of the AP, all or substantially the whole of which is preferably in the form of spherules having a diameter of up to 500 μm, and most important condition in this invention is that the pitch must contain no more than 25% by weight of component C and at least 25% by weight of component B based on the total weight of the pitch. In other words, the process of the present invention comprises preparing the starting pitch having the abovementioned characteristics, holding the pitch in a molten state, settling the pitch under the condition in which the AP spherules are likely to deposit while coalescing with one another but the thermal decomposition polycondensation reaction of the pitch components does not take place remarkably, that is, at a temperature in the range of from 350° C. to 430° C. and preferably from 360° C. to 390° C., for a sufficient time corresponding to the temperature employed, permitting the AP having a large density to coalesce as a continuous phase in the lower layer, and separating the continuous AP phase from a portion in the upper layer containing a major proportion of the IP having a smaller density and withdrawing the lower AP layer.

The term "settling" used in this specification means such a state in which strong agitation or fluidization that prevents the deposition of the AP is not applied to the liquid system of the molten pitch.

As the characteristics of the starting pitch to be subjected to the settling separation step, if the AP content is below 20%, the yield of the lower layer pitch in this step would decrease, and the softening point of the lower layer pitch is likely to increase and the resulting pitch has considerably inferior moldability. If the AP content of the pitch is higher than 70%, on the other hand, the molecular weight of the pitch and its viscosity generally becomes so large that the separation between the upper and lower layers becomes insufficient in the settling separation step, and even if they do separate, the softening point of the lower layer pitch is likely to become higher. It is often observed that the upper and lower layers can be separated even when a pitch having the AP content of 70 to 80% is used, if the pitch is settled at a considerably lower temperature for an extended period of time. In this case, the yield of the lower layer pitch having a greater content of the AP becomes high but the softening point of the lower layer pitch is likely to become higher because the thermal reaction generally proceeds excessively at the prior stage. And, in this case, the IP spherules having a large size leave with difficulty the lower layer, and also an optically anisotropic pitch containing the large spherical IP of a diameter of at least 200 μm or the formless IP mass is likely to be formed and such a pitch is of course not preferable from the aspect of spinnability as well as the performance of carbon fibers produced from such a pitch. In order to obtain the optically anisotropic pitch of the present invention, therefore, the starting pitch having the AP content ranging from about 20% to about 70% and preferably from about 30% to about 50% is subjected to the settling separation step. As to the preferred morphology of the AP at this stage, the pitch containing the AP which has not yet coalesced significantly but are dispersed in the form of a nearly true sphere having a diameter of 500 μm or below and preferably 300 μm or below is subjected to the settling separation step.

If a large number of large formless AP or large AP spherules having a diameter of at least 500 μm are observed in this stage, these AP often contain considerably large IP and if these large AP masses are deposited, they are likely to entrap the IP portion and coalesce with one another in the lower layer. As a result, the resulting optically anisotropic pitch is likely to contain the large IP entrapped in the continuous AP formed in the lower layer.

However, the particle diameter changes if the stirring condition is remarkably changed.

On the other hand, if a pitch containing only the AP spherules having an extremely small diameter is used in the deposition separation step, an extended period of time is undesirably required for the coalescence and deposition of the AP spherules. In other words, even if the AP content is within the aforementioned preferred concentration range, a pitch in which the AP spherules having a diameter of at least 20 μm can be hardly observed under a microscope is not suitable because an extended period of time is necessary for coalescing and deposition when the pitch is subjected to the settling separation step, and the yield of the lower layer is also lower.

In order to obtain the optically anisotropic pitch of the present invention, it is another important discovered condition that the pitch to be subjected to the settling separation step should have a sufficiently low content of component C, that is, the quinoline- or pyridine-insoluble component, and a sufficiently high content of component B, that is, the benzene-insoluble but quinoline- or pyridine-soluble component.

It has been found by the present inventors that the contemplated optically anisotropic pitch of the present invention can be produced with a high yield by subjecting to the settling separation step a starting pitch containing up to 25 wt% of component C and at the same time at least 25 wt% of component B.

More specifically, even though the starting pitch to be subjected to the settling separation step has the aforementioned AP content and AP morphology, large quantities of the IP spherules having a diameter of 200 μm of more are likely to be formed in the resulting optically anisotropic pitch in the lower layer if the starting pitch contains 25 wt% or more of component B or if it contains not greater than 25 wt% of component C. In such a case, the component C in the large layer is concentrated to about 70 wt% or more, the softening point of the resulting pitch becomes higher and its spinnability becomes low. Moreover, carbon materials having good performance can not be obtained easily.

In the present invention, if the starting pitch to be subjected to the settling separation step has the aforementioned AP content and preferably the aforementioned AP morphology and contains up to about 25 wt%, preferably up to 20 wt% of component C and at the same time at least 25 wt%, more preferably from 30 wt% to about 65 wt%, of component B, the pitch deposited in the lower layer after the settling separation step is the aforementioned optically anisotropic pitch of low softening point of the present invention in which, characteristically, the fine IP spherules are dispersed in a suitable amount in the AP matrix.

In this case, it is generally observed that 20 wt% to 45 wt% of component A is contained while 5 wt% to 20 wt% of the remaining component O (heptane-soluble component) is contained. Such a composition is preferable as the starting material for producing the pitch of the present invention.

Next, the conditions for the settling separation step will be explained in detail. The temperature to be used ranges from 350° C. to 430° C. and preferably from 360° C. to 390° C. The step may be carried out at a predetermined temperature within this range, or the temperature need not necessarily be constant.

Since this step is primarily directed to deposition and coalescence of the major portion of AP in the lower layer, the thermal decomposition polycondensation reaction should be avoided in this step as much as possible. It is necessary that even within the abovementioned temperature range, the residence time should be shortened if a high temperature is employed. At a high temperature such as 430° C. or above, for instance, the thermal reaction of the pitch becomes remarkable and the settling separation operation can not be carried out properly, however short it may be. If the temperature is too low, on the other hand, the viscosity of the pitch as a whole, especially the viscosity of the IP portion, is so high that the AP spherules can not easily precipitate and separation can not be effected even if an extended period of time is used.

The softening point of the pitch used is closely associated with the temperature and residence time employed in the deposition separation step. Namely, in order to use the abovementioned temperature range, the pitch to be used for the settling separation step must have a softening point of no higher than 250° C. If the softening point is higher, deposition and separation of the pitch do not occur sufficiently because the melt viscosity of the molten pitch within the abovementioned temperature range is too high.

The preferred residence time in the settling separation step in the present invention varies depending upon the softening point of the pitch and upon the temperature used in the step, and can be selected from the range of from about 5 minutes to about 4 hours. Needless to say, the deposition separation step must be carried out in a non-oxidizing atmosphere. It may naturally be carried out in the stream of an inert gas or under an elevated pressure. Generally, the step is carried out under a pressure close to the normal pressure in the stream of a small amount of non-oxidizing gas or within an airtight sealed vessel.

As to the agitation during the deposition separation step, the object can be accomplished without agitation at all, but agitation or fluidization of the pitch as a whole may be effected to such an extent as not to prevent the precipitation of the AP spherules, in order to carry out continuously the separation or to make uniform the temperature distribution of the overall system. In the settling separation step, the portion having a large AP concentration in the lower layer can be most easily separated from the portion having a large IP concentration in the upper layer by opening a valve of a discharge port at the lower part of a settling separation tank so as to permit the outflow of the lower layer and thus to withdraw the intended pitch product. In this case, the boundary between the upper layer and the lower layer can be easily detected from the relation between the differential pressure and flow rate in the withdrawing line because the viscosity of the upper layer is remarkably different from that of the lower layer.

Separation can also be effected by various other methods such as one in which separation is effected by utilizing the difference in hardness between the upper and lower layers after solidification; a method which permits the outflow of the upper layer at a temperature at which the lower layer does not fluidize, by utilizing the remarkable difference in softening points between the upper and lower layers; a method using a settling drum for separating continuously two phases in an ordinary manner, and so forth. Furthermore, centrifugal settling, a kind of settling method, can also be employed in order to carry out efficiently the deposition, coalescence and separation of the AP within a short period of time. In this case, the rotary shaft and bearing are cooled with water, oil, or air etc. since the rotating portions reach a high temperature.

The characterizing feature of the improved process for producing the pitch in accordance with the present invention resides in that a pitch containing a suitable amount of AP, which has not been completely heat-decomposed and polycondensed and has specific composition and properties as described already, is subjected to the settling separation step under the specific condition and the AP is concentrated and thereafter withdrawn. The production process for the pitch having the specific composition and properties to be used in this process is not limitative, in particular, in the present invention and pitches produced by various production processes may be used. However, such a pitch can be easily produced in accordance with the following process.

Namely, the starting material is a pitch material by-produced in the petroleum or coal industry, a so-called heavy hydrocarbon oil tar or pitch containing large quantities of aromatic carbon. The starting material is subjected to the heat reaction which is primarily the thermal decomposition polycondensation reaction at a temperature within the range of from about 380° C. to about 460° C. and preferably from about 400° C. to about 430° C. under normal pressure in the stream of an inert gas while promoting topping of decomposition products and the like. When a pitch having the properties within the aforementioned suitable ranges to be subjected to the aforementioned settling separation step is formed, the reaction is stopped and the pitch is transferred to the settling separation step. The timing at which the reaction is to be stopped in this case can be experimentally determined in advance depending upon the combination of the properties of the starting material, the flow rate of the inert gas and the reaction temperature. In this case, the flow rate of the inert gas can not be stipulated because it varies depending upon the size and shape of a reactor and quantities of residual matters of the liquid phase. Generally, however, the contemplated pitch can not be obtained easily unless at least 1 l/min of the inert gas is permitted to flow per Kg of the residual matters of the liquid phase.

The inert gas in this case may be permitted to flow on the surface of the liquid phase or may be bubbled into the liquid phase.

On the other hand, in carrying out the heat reaction comprising primarily the thermal decomposition polycondensation reaction at a temperature within the range of from about 380° C. to about 460° C. and preferably from 400° C. to 430° C. using the same starting material as above without the flow of an inert gas, it is possible to carry out the reaction under normal pressure or elevated pressure of 2 $Kg/cm^2$ to 200 $Kg/cm^2$ at which reflux is more likely to occur and then, to remove low-molecular weight components such as decomposition products after the heat reaction comprising primarily the thermal decomposition polycondensation reaction, at a temperature within the range of from about 300° C. to about 380° C. and preferably from 330° C. to 370° C. by means of vacuum distillation or stripping distillation in the stream of an inert gas. In this case, too, the temperature and time for the thermal decomposition polycondensation reaction and those for topping are experimentarily determined in accordance with the properties of the starting material so as to produce a pitch having the properties within the aforementioned suitable range to be subjected to the decomposition separation step.

The term "inert gas" used in the foregoing description refers to gases which do not remarkably cause the chemical reaction with the pitch material at a temperature of around 400° C. and include $N_2$, Ar, steam, carbon dioxide and low-molecular weight hydrocarbons.

In the process for producing the pitch in accordance with the present invention, the upper layer pitch consisting principally of the IP and by-produced in the settling separation step is not to be discarded but is to be subjected to a suitable treatment such as gentle thermal decomposition polycondensation reaction so that it can be recycled to the settling separation step, or it can be converted to an optically anisotropic pitch of higher AP content. By this treatment, the yield of the final pitch can be improved.

The inventors of the present invention have also confirmed that the decomposition distillate by-produced in the topping stage of the thermal reaction, consisting principally of thermal decomposition products, can be charged again to the thermal reaction and used as the pitch material after being adjusted suitably by distillation. Namely, the decomposition distillate has an extremely wide range of boiling points but the components having a boiling point of about 350° C. or more, calculated as a value at normal pressure, have a high content of aromatic carbons and can be converted into a pitch having suitable characteristics to be subjected to the deposition, coalescence and separation step of the AP by subjecting them again to the thermal decomposition, polycondensation and topping. As a result, the optically anisotropic carbonaceous pitch of the present invention can be produced with a higher yield.

If the abovementioned thermal decomposition distillate is used as the starting material, it is preferred to employ the abovementioned pressure method as the heat reaction step.

Next, a process for producing carbon fibers and the so-called graphite fibers using the optically anisotropic carbonaceous pitch of the present invention and the characterizing feature of the process will be explained.

A heretofore known spinning method can be employed as the spinning method. Namely, the pitch is charged into a metallic spinning vessel having spinnerets of a 0.1 mm to 0.5 mm diameter at the lower portion and while the pitch is kept at a predetermined temperature within the range of from 280° C. to 370° C. in an inert gas atmosphere and in the molten state, the pressure of the inert gas is elevated to several hundreds of mmHg, whereby the molten pitch is extruded from the spinnerets and caused to flow down. While the temperature of the flowing portion of the pitch and the atmosphere are being controlled, the pitch fiber flowing down is taken up on a bobbin rotating at a high speed or is collected in a collection box therebelow while being taken up by a gas stream. In this instance, continuous spinning is possible by pressure-feeding a pitch, that has been molten in advance, with gear pumps or screw feeders into the spinning vessel. In the abovementioned method, it is possible to employ a method in which pitch fibers stretched and taken up in the proximity of the spinneret by a gas descending at a high speed and at a constant temperature so as to form on a belt conveyor below the spinnerets long or short fibers or a mat-like non-woven fabric of pitch fibers having the fibers entangled with one another.

Further, it is possible to employ a method in which a cylindrical spinning vessel equipped with spinnerets on the circumferential wall is rotated at a high speed, a molten pitch is continuously fed to the vessel and extruded from the circumferential wall by the centrifugal force and the pitch fiber spun by the rotation is accumulated.

In any of these methods, the suitable spinning temperature is within the range of from 280° C. to 370° C., which is a melt-spinning temperature of the pitch of the present invention and is characterizingly lower than the conventional temperature for high AP pitch. Accordingly, thermal decomposition and thermal polymerization in the spinning step are extremely slow and consequently the obtained pitch fiber has substantially the same chemical composition as that of the pitch before spinning.

Even at such a low spinning temperature, the pitch of the present invention behaves practically as if it were composed of one substantially homogeneous phase and spinning can be made smoothly with high spinnability and less yarn breaking. Under the constant condition, fibers having a substantially constant fiber diameter can be spun. Thus, pitch fibers having generally a diameter ranging from 7 μm to 15 μm can be obtained by adjusting spinning conditions.

When the resulting pitch fiber is pulverized, fractionated into the components O, A, B and C using an organic solvent and analyzed, substantially the same chemical composition and characteristic values as those of the pitch before spinning can be obtained and are thus confirmed to be within the aforementioned ranges stipulated in the present invention.

Conventional optically anisotropic pitches of high AP content are generally spun while being kept in a molten state at a temperature of as high as from 370° C. to 430° C. Since thermal decomposition and thermal polymerization occur remarkably at such a temperature, in these cases, the composition and structure of the pitch fiber after spinning are more carbonized than those of the pitch before spinning.

On the other hand, in the case of the pitch fiber in accordance with the present invention, the pitch composition hardly changes before and after spinning so that even if any problems occur in the spinning step, the pitch fiber can be molten again for re-use.

When the pitch fiber obtained from the optically anisotropic carbonaceous pitch of the present invention in the abovementioned manner is fixed in an unsaturated polyester resin, then polished and observed under a polarizing microscope, it can be observed that the entire surface of the section parallel to the fiber axis consists of an optically anisotropic phase and the surface its orientation layer is substantially parallel to the fiber axis, The fine IP spherules, that have been seen dispersed in the AP in the pitch mass, can no longer be observed. Presumably, this is because the spherules are stretched into further smaller size spherules by the shear stress when the pitch passes through the spinneret or because the IP and AP dissolve into one another.

The optically anisotropic carbonaceous pitch fiber in accordance with the present invention can be converted into high-strength, high-modulus carbon fiber by oxidizing the pitch fiber in an oxidizing atmosphere to obtain an infusible fiber and then heating it to at least 1,000° C. in an inert atmosphere. A graphite fiber having high strength and yet high elastic modulus can be obtained by heating the carbon fiber to a higher temperature such as at least 2,000° C.

Various processes may be employed for oxidizing the pitch fiber to obtain the infusible carbon fiber depending upon the combination of the temperature, the oxidizing agent used and the reaction time.

Though the heretofore known processes can be used, the oxidizing reaction is carried out at a temperature lower than the heretofore known optically anisotropic pitches because one of the features of the pitch of the present invention is its low softening point. Otherwise, the pitch fiber would be partially fused or crimped so that a high-quality product can not be obtained eventually. It is also desirable to treat the pitch fiber in an atmosphere containing an oxidizing agent such as halogen, $NO_2$, ozone or the like at a temperature up to 200° C. for a short period of time. However, an easy and reliable process comprises maintaining the pitch fiber at a temperature lower by from 30° C. to 50° C. than the softening point of the pitch, that is, generally from 200° C. to 240° C., in an oxygen gas atmosphere for 10 minutes to 2 hours depending upon the temperature employed till sufficient infusibility can be obtained, and thereafter raising the temperature up to about 300° C., whenever necessary, to terminate the infusibilizing treatment. Among the pitches of the present invention, those having a softening point of 280° C. or higher are further preferable because infusibilization can be effected by maintaining them at a temperature in the range of from 230° C. to 250° C. for about 30 minutes to about 2 hours.

When the optically anisotropic carbonaceous pitch fiber thus infusibilized is carbonized in a vacuum or in a chemically inert gas atmosphere of argon, high-purity nitrogen or the like at a temperature within the range of from 1,000° C. to 2,000° C., there can be obtained the so-called high-strength, high-modulus carbon fibers, and when the graphitization reaction is carried out by further raising the temperature to 2,000° C. to 3,000° C., there can be obtained the so-called graphitized fibers.

The present invention does not limit the carbonization and graphitization processes and heretofore known processes may be employed. In any case, when the optically anisotropic carbonaceous pitch of the present invention is used as the starting material, there can be obtained an advantage that the temperature can be elevated from room temperature to the final carbonizing temperature at a sufficiently large speed with a substantially constant temperature gradient and the residence time at the final carbonization temperature is not necessary. Hence, the product can be rapidly cooled immediately after the temperature reaches the final carbonization temperature. This simplifies the construction of a carbonizing furnace and facilitates the carbonization process.

It can be understood from the foregoing description that the optically anisotropic carbonaceous pitch of the present invention has specific and novel microscopic morphology, physical properties and contents of its chemical components. For these reasons, it can be further understood that the pitch of the present invention has highly oriented molecules suitable for producing high-performance carbon fibers and graphite fibers, and a lower softening point as well as practical homogeneity advantageous for spinning. It can also be understood that the optically anisotropic carbonaceous pitch having the aforementioned morphology, characteristics and composition of components can be produced especially efficiently by the aforementioned specified and controlled production process.

Though the optically anisotropic pitch of the present invention having specific morphology, characteristics and constituent composition is a practically homogeneous pitch containing at least 80% of the AP, it has an extremely low softening point (320° C. or below) so that it can be spun at a sufficiently low melt-spinning temperature (380° C. or below and 280° C. to 370° C. as an ordinary embodiment of the invention) and provides the following effects.

That is, the pitch can be spun at a temperature lower than the temperature at which the thermal decomposition polycondensation reaction proceeds remarkably, an behaves as a homogeneous pitch at that temperature. For this reason, spinnability of the pitch (yarn breaking, yarn fineness and uniformity of yarn size) is excellent and productivity can be improved in the spinning step.

Since degradation of the pitch does not occur during spinning, the quality of the resulting fiber carbon is stable. Since generation of decomposition gas and infusible matters is markedly low, the spun pitch fiber is devoid of defects (such as air bubbles and solid foreign particles) and the resulting carbon fiber has increased strength. Moreover, since almost all the optically anisotropic carbonaceous pitch of the present invention is substantially in a state of liquid crystal having excellent molecular orientation, the molecular orientation of the graphite-like structure in the direction of the fiber axis develops well in the resulting carbon fiber, thereby providing a high modulus to the carbon fiber. The section of the resulting fiber in a direction perpendicular to the fiber axis is compact and the orientation in the cross-sectional direction of the fibrils is relatively small and does not become concentric or radial so that no cleavage occurs in the direction of the fiber axis.

Hereinafter, the present invention will be described with reference to Examples and Comparative Examples.

EXAMPLE 1

Properties of the starting carbonaceous pitch were as follows. It had a softening point of 223° C. When observed with a reflecting polarizing microscope, the AP accounted for about 35% mostly in the form of a spherule of an about 50 μm diameter. A slight amount of the AP spherules of an about 100 μm diameter were also observed, but the AP spherules of a diameter exceeding 200 μm were hardly observed. These AP spherules were dispersed in the IP matrix. Upon solvent extraction analysis, the starting pitch was found to contain 31.0 wt% of component B and 6.5 wt% of component C.

300 g of the carbonaceous pitch was placed in a cylindrical glass vessel having a 500 ml capacity, held at 380° C. for 1 hour without agitation in a nitrogen atmosphere and then left standing for cooling. The pitch was withdrawn by destroying the vessel. It could be seen even with naked eyes from the difference in luster that the upper layer and lower layer of this pitch were separated from each other. About 59.1 g of the lower layer pitch was obtained. The section of this pitch mass as cut in the vertical direction was polished. When the section was observed and photographed by a reflecting polarizing microscope, the IP phase having a diameter of 50 μm or more was not at all observed in the section (about 3 $cm^2$) in the 50X magnification. When the section was observed in the 300X magnification, it was confirmed that the IP dispersed in the AP was mostly IP spherules having diameters of from 1 μm to 20 μm that were dispersed substantially uniformly over the entire surface of the section. By calculating the area of this IP portion, the IP content was found to be about 8%.

When the viscosity characteristics of this lower layer pitch were examined, it was found that the viscosity was 52 poise at 350° C. and remained substantially constant at a shear rate of up to at least 100 $sec^{-1}$, and 9 poise at 380° C. and remained substantially constant at a shear rate of up to at least 300 $sec^{-1}$.

The lower layer pitch had a softening point of 252° C. Upon solvent extraction analysis, the pitch was found to contain 8.4 wt% of component 0, 36.2 wt% of component A, 25.00 wt% of component B and 30.4 wt% of component C. The C/H atomic ratio of this pitch was 1.69.

Next, this pitch was charged into a spinning vessel having a nozzle of a 0.5 mm diameter, molten at 335° C., extruded at a nitrogen pressure of about 100 mmHg and taken up for spinning on a bobbin rotating at a high speed. Thus, a pitch fiber having a fiber diameter of 9 μm to 10 μm could be obtained at a take-up speed of 500 m/min for an extended period of time without yarn breaking.

The resulting pitch fiber was held at 200° C. for 2 hours in an oxygen atmosphere, then at 230° C. for 1 hour, and then, in an inert atmosphere heated up to 1,500° C. at the rate of 50° C./min. Immediately thereafter, the pitch fiber was left standing for cooling, thereby providing a carbon fiber. When measured by a tensile tester, the carbon fiber was found to possess tensile strength of 3.2 GPa and tensile elastic modulus of 210 GPa.

A part of the carbon fiber was baked at 2,400° C. in an argon atmosphere to obtain a so-called graphite fiber. The graphite fiber thus obtained has tensile strength of 2.3 GPa and tensile elastic modulus of 440 GPa.

EXAMPLE 2

Properties of the starting pitch were as follows. It had a softening point of 217° C. and its AP was about 60% and spherical and dispersed in the IP matrix. The AP spherules having a diameter of 300 μm or more were hardly observed. Those having a diameter of from 50 μm to 100 μm were present in a considerable amount and the AP consisted predominantly of spherules having a diameter of up to 200 μm. Upon solvent extraction analysis, the starting pitch was found to contain 35.9wt% of component B and 12.9 wt% of component C.

This carbonaceous pitch was held for 2 hours in the same way as in Example 1 except that the temperature was 400° C., 380° C., 360° or 340° C. The resulting pitches were observed and analyzed with the results shown in Table 1.

At the temperature of 400° C., 380° C. or 360° C., separation could be seen clearly between the upper layer and the lower layer, and the lower layer was an optically anisotropic pitch having the characteristic features of the present invention. At the temperature of 340° C., however, separation hardly occurred between the upper and lower layers.

TABLE 1

| | Settling separation temperature and properties of a lower-layer pitch | | | |
|---|---|---|---|---|
| Settling temperature | 400° C. | 380° C. | 360° C. | 340° C. |
| lower layer yield wt % | 27.5 | 30.2 | 30.5 | not separated |
| IP % | 2 | 4 | 7 | — |
| AP % | 98 | 96 | 93 | — |
| state of IP | spherules of about 5 μm | spherules of about 5 μm | spherules of about 20 μm | — |
| content of component O wt % | 12.0 | 11.0 | 11.0 | — |
| content of component A wt % | 22.1 | 26.5 | 29.6 | — |
| content of component B wt % | 18.0 | 24.5 | 24.2 | — |
| content of component C wt % | 47.9 | 38.0 | 36.1 | — |
| softening point °C. | 281 | 263 | 257 | — |

TABLE 1-continued

| | Settling separation temperature and properties of a lower-layer pitch | | | |
|---|---|---|---|---|
| Settling temperature | 400° C. | 380° C. | 360° C. | 340° C. |
| C/H atomic ratio | 1.69 | 1.70 | 1.69 | — |

COMPARATIVE EXAMPLE 1

The starting pitch had a softening point of 270° C. and the AP content of about 80%. Though some spherules were observed, most of the pitch was composed of formless mass-like AP and the IP existed in the gaps of such AP masses. The pitch contained 30.1 wt% of component B and 28.3 wt% of component C.

When this pitch was maintained at 380° C. for 2 hours in the same way as in Example 1, separation did not occur at all between the upper and lower layers.

COMPARATIVE EXAMPLE 2

The starting pitch had a softening point of 240° C. and the AP content of about 60%. Substantially the whole of AP were spherical but spherules having a diameter of 500 μm or more were not contained. The pitch contained 26.2 wt% of componen t B and 33.8 wt% of component C.

When this pitch was held at 380° C. for 2 hours in the same way as in Example 1, the upper and lower layers were separated clearly from each other and the yield of the lower layer was 45.5%.

Upon examination, this lower layer pitch was found to have the IP content of 11% and hence the AP content of about 89%. It was observed that the IP spherules having a diameter of 200 μm or more were dispersed in the AP. The pitch had a softening point of 288° C. Upon solvent extraction analysis, it was found to contain 6.6 wt% of component 0, 13.8 wt% of component A, 9.4 wt% of component B and 70.2 wt% of component C.

Spinnability of this pitch was tested in accordance with the same spinning method as used in Example 1 except that the spinning temperature was changed. It was found that though the molten pitch could be extruded at around 370° C., spinning could not be made at all because spinnability was so poor.

COMPARATIVE EXAMPLE 3

The starting pitch had a softening point of 190° C. and the AP content of about 15%. Substantially the whole of AP consisted of true spheres having a diameter of up to 50 μm. The pitch contained 28.4 wt% of component B and 6.5 wt% of component C.

When this pitch was maintained at 380° C. for 2 hours in the same way as in Example 1, separation could be observed between the upper and lower layers, but the yield of the lower layer was about 9%. Upon examination, it was found that this lower layer pitch contained about 98% of the AP, and about 2% IP was spherical and dispersed in the AP. Though the IP spherules having a diameter of 200 μm or more were not observed, the lower layer pitch had a softening point of 350° C. or above. Upon solvent extraction analysis, the pitch was found to contain 11.2 wt% of component 0, 15.6 wt% of component A, 0.2 wt% of component B and 73.0 wt% of component C.

EXAMPLE 3

The starting material was a tar obtained by vacuum distilling a heavy oil by-produced in petroleum refining and having an aromatic carbon fraction $f_a$ of 0.53. This tar consisted principally of components having a boiling point of at least 450° C. which was a value calculated under normal pressure, and an aromatic carbon fraction $f_a$ of 0.70.

6 kg of this tar was charged in a stainless steel reactor having a 10 l inner capacity and held at 400° C. for 8 hours under normal pressure while 20 l/min of nitrogen gas was made to flow (not blown into the liquid phase of the sample but made to flow over the liquid phase). The temperature was raised at the rate of 15° C./min and cooling was effected by leaving the sample standing for cooling from 400° C. to 250° C. in the course of about 15 minutes. Agitation was effected with an impeller from the start of the temperature elevation till cooling down to 250° C.

Residual pitch of this reaction was found to have a softening point of 232° C. and the AP content of about 50%. Though the AP was seen composed mostly of spherules having diameters ranging from 100 μm to 200 μm, those having a diameter of 300 μm or more were hardly observed. The content of component B was found to be 34.4 wt% and that of component C 16.7 wt%.

When this pitch was maintained at 380° C. for 1 hour without agitation in the same way as in Example 1, the upper and lower layers were separated clearly from each other. Upon examination, it was found that the lower layer pitch had a softening point of 253° C., the AP content of about 87% and the IP content of about 13%, and a large number of fine IP spherules were dispersed in the AP. The IP spherules consisted mostly of those having diameters ranging from 1 μm to 20 μm. Though some spherules having a diameter of around 50 μm were observed, those having a diameter of 200 μm or more were not at all observed. Upon solvent extraction analysis, the lower layer pitch was found to contain 4.5 wt% of component 0, 31.7 wt% of component A, 26.9 wt% of component B and 36.9 wt% of component C.

This lower layer pitch was subjected to spinning, infusibilization, carbonization and graphitization treatment in the same way as in Example 1 and there were obtained carbon fibers having tensile strength of 2.8 GPa and tensile elastic modulus of 220 GPa and graphite fibers having tensile strength of 2.1 GPa and tensile elastic modulus of 430 GPa.

EXAMPLE 4

The starting material was a tar-like substance obtained by vacuum distilling a heavy oil by-produced in petroleum refining and having an aromatic carbon fraction $f_a$ of 0.43. This tar-like substance consisted principally of components having a boiling point of 450° C., or more, as a value calculated under normal pressure, and had an aromatic carbon fraction $f_a$ of 0.49.

6 Kg of this tar-like substance was charged in a stainless steel reactor having a 10.0 l inner capacity and subjected to the thermal decomposition polycondensation reaction at 430° C. for about 2 hours with agitation while nitrogen gas was made to flow into the reactor and over the liquid phase at the rate of about 30 l/min. As a result, there was obtained 755 g of residual pitch. The pitch had a softening point of 231° C. and the AP content of about 45%. The AP spherules having a diameter of 200 μm or more were hardly observed and most of them were true spheres having a diameter of up to 100 μm. The content of component B was 43.1 wt% and that of component C was 13.4 wt%.

500 g of this pitch was placed in a brass container having a 1 l inner capacity and a discharge valve provided at its lower part, and maintained at 380° C. for 2 hours while agitating at 15 r.p.m. During this period, nitrogen gas was blown on the liquid phase at the rate of about 0.1 l/min to prevent oxygen from entering the system. Thereafter, while the pitch was kept at 350° C., the valve at the lower part of the container was opened and a viscous pitch was allowed to flow out in an amount of 182 g. And then, before the viscosity of the flowing pitch changed drastically, about 45 g of pitch was obtained, and 262 g of the residual pitch having a lower viscosity was further allowed to flow out. 182 g of the pitch first withdrawn, 45 g of the pitch withdrawn at an intermediate stage and the rest of the pitch finally withdrawn were hereinbelow referred to as "lower layer pitch", "intermediate layer pitch" and "upper layer pitch", respectively. The lower layer pitch contained about 84% of AP and about 16% of IP, almost all of which IP consisted of fine spherules of a diameter of 20 μm or below. Though some spherules of a diameter of around 50 μm were observed, spherules of a diameter exceeding 200 μm could not be observed at all. The pitch had a softening point of 255° C. Upon solvent extraction analysis, the pitch was found to have the composition consisting of 6.2 wt% of component 0, 29.0 wt% of component A, 28.0 wt% of component B and 36.8 wt% of component C. This pitch was hereafter referred to "pitch A".

On the other hand, the upper layer pitch had the AP content of about 25% in the form of a spherule having a diameter of up to 50 μm, and had a softening point of 216° C. Upon solvent extraction analysis, the pitch was found to contain 8.9 wt% of component 0, 25.3 wt% of component A, 59.5 wt% of component B and 6.2 wt% of component C. Next, 200 g of this upper layer pitch was charged in a stainless steel reactor having a 500 ml inner capacity and again heat-agitated at 400° C. for 2 hours. The reaction was carried out while nitrogen was made to flow on the liquid phase at the rate of 2 l/min.

As a result, a pitch was obtained which had a softening point of 225° C. and the AP content of about 55%. The AP contained large quantities of spherules having a diameter of up to 100 μm, and while spherules having a diameter from 100 to 200 μm were observed, hardly any spherules were observed which had a diameter of 200 μm or more. The pitch contained 50.6 wt% of component B and 13.4 wt% of component C. The yield was 82 wt% with respect to the feed before the start of the reaction.

Next, this pitch was maintained at 380° C. for 2 hours in a glass container having a 300 ml capacity without agitation in the same way as in Example 1 to separate the upper layer from the lower layer. The yield of the lower layer pitch was 37 wt%. Its AP content was 97%. The IP spherules having diameters ranging from about 1 μm to about 10 μm were seen dispersed in the AP but those having a diameter of 50 μm or more could not be observed.

The lower layer pitch had a softening point of 257° C. and contained 6.3 wt% of component 0, 39.3 wt% of component A, 22.1 wt% of component B and 32.3 wt% of component C. This pitch was referred to as "pitch B".

The pitch A obtained by the thermal reaction and settling separation in the first stage and the pitch B obtained by the recycling thermal reaction and separation of the upper layer pitch were subjected to spinning, infusibilization and carbonization in the same way as in Example 1 in order to evaluate their properties. The results are shown in Table 2.

EXAMPLE 5

The decomposition distillate formed in the thermal decomposition polycondensation reaction and trapped in Example 4, was vacuum-distilled to obtain a product having a boiling point of at least about 350° C. as a value calculated under normal pressure. 700 g of this reaction product was charged and sealed in a stainless steel autoclave having a 1 l inner capacity and was subjected to the thermal decomposition polycondensation reaction at 430° C. for 3 hours. In the interim, the thermal decomposition gas was withdrawn through a leak valve so as to keep the pressure at about 5 kg/cm$^2$. After the reaction was completed, 689 g of the residual liquid was transferred to a distillation still having a 1 l inner capacity and subjected to stripping at 380° C. for 5 hours while nitrogen gas was made to flow at the rate of 6 l/min. About 157 g of pitch was obtained. This pitch contained 1.9% of component C and 56.5% of component B and had a softening point of 247° C. When the polished surface of this pitch was measured with a polarizing microscope, the pitch was found to contain about 30% of AP spherules having a diameter of up to about 200 μm.

This pitch was settled at 380° C. for 2 hours in a glass container having a 300 ml inner capacity in the same way as in Example 1, and separated into the upper and lower layers. The lower layer pitch was found to be an optically anisotropic pitch containing about 5% of IP, almost all of which were spherules having a diameter of up to 10 μm. The lower layer pitch had a softening point of 272° C. Upon solvent extraction analysis, the pitch was found to contain 9.0 wt%, 24.7 wt%, 36.4 wt% and 29.9 wt% of components O, A, B and C, respectively. This lower layer pitch was hereafter referred to as "pitch C".

The pitch was subjected to spinning, infusibilization and carbonization and evaluated in the same way as in Example 1. The results are shown in Table 2.

TABLE 2

| Pitch samples | Pitch properties: softening point (°C.) | Pitch properties: quinoline-insoluble component (wt %) | AP content (%) | Spinnability of optically anisotropic pitch of this invention and properties of carbon fiber: Spinning conditions: temperature (°C.) | velocity (m/min) | frequency of yarn breaking (times/10 min) | Properties of carbon fiber (carbonized at 1,500° C., average values of 16 samples): fiber diameter (μm) | tensile strength (GPa) | modulus of tensile elasticity ($10^2$ GPa) |
|---|---|---|---|---|---|---|---|---|---|
| pitch A (Ex. 4) | 255 | 36.8 | 84 | 340 | 500 | below 1 | 9.6 | 2.8 | 2.1 |
| pitch B (Ex. 4) | 257 | 32.3 | 97 | 340 | 500 | below 1 | 9.2 | 3.1 | 2.5 |
| pitch C (Ex. 5) | 272 | 29.9 | 95 | 350 | 500 | below 1 | 9.6 | 3.2 | 2.4 |

What is claimed is:

1. A substantially homogeneous, optically anisotropic carbonaceous pitch for use in carbon fibers or the like, characterized in that the major portion of said pitch consists of a continuous, optically anisotropic phase, said optically anisotropic phase containing spherules of an optically isotropic phase having diameters ranging from about 1 μm to about 100 μm and dispersed in said optically anisotropic phase, the content of said optically isotropic spherules being up to about 20% on the basis of said pitch as a whole, said pitch containing substantially no optically isotropic spherules having a diameter of about 200 μm or more, said pitch containing at least about 30 wt% of a quinoline-soluble component, 20 to 50 wt% of a benzene soluble component, 15 to 40 wt% of an n-heptane insoluble but benzene soluble component, and 5 to 15 wt% of an n-heptane soluble component, and wt%s being based on said pitch as a whole, and said pitch having a softening point of from about 230° C. to about 320° C. and a carbon-to-hydrogen atomic ratio C/H of up to 2.0.

2. The optically anisotropic carbonaceous pitch as defined in claim 1 wherein the diameter of said optically isotropic spherules is substantially up to about 50 μm.

3. The optically anisotropic carbonaceous pitch as defined in claim 1 wherein the content of said optically isotropic spherules is up to about 10% on the basis of said pitch.

4. The optically anisotropic carbonaceous pitch as defined in claim 1 wherein the softening point is within the range of from 240° C. to 290° C.

5. The optically anisotropic carbonaceous pitch as defined in claim 1 wherein the content of said quinoline-soluble component is at least 50 wt%.

6. The optically anisotropic carbonaceous pitch as defined in claim 1 wherein the viscosity of said pitch at 350° C. is within the range of from about 10 poise to about 200 poise.

7. The optically anisotropic carbonaceous pitch as defined in claim 1 wherein the viscosity of said pitch at 380° C. is within the range of from about 2 poise to about 50 poise.

8. The optically anisotropic carbonaceous pitch as defined in claim 1 wherein the content of a benzene-insoluble component is from 50 wt% to 80 wt% on the basis of said pitch and a benzene-insoluble but quinoline-soluble component in said benzene-insoluble component is from 20 wt% to 50 wt% on the basis of said pitch.

9. The optically anisotropic carbonaceous pitch as defined in claim 1 wherein the content of said quinoline-insoluble component is up to 40 wt% on the basis of said pitch.

10. The optically anisotropic carbonaceous pitch as defined in claim 9 wherein the content of said quinoline-insoluble component is up to 30 wt% to 40 wt% on the basis of said pitch.

11. The optically anisotropic carbonaceous pitch as defined in claim 1 wherein the carbon-to-hydrogen atomic ratio C/H is from 1.6 to 1.9.

12. The optically anisotropic carbonaceous pitch as defined in claim 11 wherein the carbon-to-hydrogen atomic ratio C/H is from 1.65 to 1.80.

13. A process for producing an optically anisotropic carbonaceous pitch for use in carbon fibers or the like comprising:

settling the major portion of a starting carbonaceous pitch in its molten state into an upper layer and a lower layer under conditions of temperature and residence time wherein optically anisotropic spherules contained in said starting carbonaceous pitch deposit and coalesce in the lower layer but the decomposition polycondensation reaction thereof does not occur remarkably, said settling operation carried on at a temperature in the range of from 350° C. to 430° C. and without agitation or with gentle and slow agitation under conditions where unnecessary fluidization does not exist, and the residence time is from 5 minutes to 4 hours depending on the temperature employed; and separating and removing the upper layer having a smaller concentration of the optically anisotropic phase from the lower layer;

wherein said starting carbonaceous pitch contains from about 20% to about 70%, on the basis of said pitch, of the optically anisotropic phase in an optically isotropic matrix, up to 25 wt%, on the basis of said pitch, of a quinoline-insoluble component and at least 25 wt%, on the basis of said pitch, of a benzene-insoluble but quinoline-soluble component, and has a softening point of up to about 250° C.; and wherein said produced optically anisotropic carbonaceous pitch of said lower layer consists of a continuous, optically anisotropic phase, said optically anisotropic phase containing spherules of an optically isotropic phase having diameters ranging from about 1 μm to about 100 μm and dispersed in said optically anisotropic phase, the content of said optically isotropic spherules being up to about 20% on the basis of said pitch as a whole, said pitch containing substantially no optically isotropic spherules having a diameter of about 200 μm or more, said produced pitch containing at least about 30 wt% of a quinoline-soluble component, 20 to 50 wt% of a benzene soluble component, 15 to 40 wt% of an n-heptane insoluble but benzene soluble component, and 5 to 15 wt% of a n-heptane soluble component, and wt%s being based on said pitch as a whole.

14. The process for producing an optically anisotropic carbonaceous pitch as defined in claim 10 wherein said starting carbonaceous pitch contains from about 30% to about 50% of the optically anisotropic phase portion in the optically isotropic matrix, up to 20 wt% of said quinoline-insoluble component and from 30 wt% to about 65 wt% of said benzene-insoluble but quinoline-soluble component.

15. The process for producing an optically anisotropic carbonaceous pitch as defined in claim 13 wherein the settling operation is carried out at a temperature in the range of from 360° C. to 390° C.

16. The process for producing an optically anisotropic carbonaceous pitch as defined in claim 13 wherein said starting carbonaceous pitch is obtained by carrying out heat-reaction and topping a starting carbonaceous heavy oil at a temperature within the range of from about 380° C. to about 460° C. in the stream of an inert gas.

17. The process for producing an optically anisotropic carbonaceous pitch as defined in claim 13 wherein said starting carbonaceous pitch is obtained by heat-reacting a starting carbonaceous heavy oil at a temperature within the range of from about 380° C. to about 460° C. under either normal pressure or elevated pressure and then removing low-molecular compounds such as decomposition products by vacuum distillation or in the stream of an inert gas.

18. The process for producing an optically anisotropic carbonaceous pitch as defined in claim 13 wherein the upper portion separated and withdrawn is recycled for re-use.

* * * * *